US008112906B2

(12) United States Patent
Paik

(10) Patent No.: US 8,112,906 B2
(45) Date of Patent: Feb. 14, 2012

(54) ARTICLE OF FOOTWEAR WITH INTERCHANGEABLE HEELS

(75) Inventor: Seung Min Paik, Busan (KR)

(73) Assignee: NIKE, Inc., Beaverton, OR (US)

( * ) Notice: Subject to any disclaimer, the term of this patent is extended or adjusted under 35 U.S.C. 154(b) by 653 days.

(21) Appl. No.: 12/258,921

(22) Filed: Oct. 27, 2008

(65) Prior Publication Data

US 2010/0101113 A1 Apr. 29, 2010

(51) Int. Cl.
*A43B 21/36* (2006.01)

(52) U.S. Cl. ..... 36/42; 36/100

(58) Field of Classification Search ..... 36/42, 100, 36/36 R, 41
See application file for complete search history.

(56) References Cited

U.S. PATENT DOCUMENTS

| | | | | | |
|---|---|---|---|---|---|
| 26,712 | A | | 1/1860 | Shaw | |
| 640,317 | A | * | 1/1900 | Perry | 36/42 |
| 908,088 | A | | 12/1908 | Gerlach | |
| 988,060 | A | | 3/1911 | Andrews | |
| 1,119,556 | A | | 12/1914 | Wesp | |
| 1,156,769 | A | | 10/1915 | Fortin | |
| 1,270,523 | A | | 6/1918 | Kaiser | |
| 1,393,175 | A | * | 10/1921 | Sherard | 36/41 |
| 1,396,299 | A | * | 11/1921 | Summerfield | 36/41 |
| 1,463,427 | A | | 7/1923 | Lavers | |
| 1,888,617 | A | | 11/1932 | Bridi | |
| 1,994,508 | A | | 3/1935 | Filippelli | |
| 2,027,482 | A | | 1/1936 | Johnson | |
| 2,043,177 | A | | 6/1936 | Kekoni | |
| 2,206,898 | A | | 7/1940 | Hustad | |
| 2,234,542 | A | | 3/1941 | Anderson | |
| 2,313,252 | A | | 3/1943 | Mayer et al. | |
| 2,431,868 | A | | 12/1947 | Gilmour | |
| 2,932,099 | A | | 4/1960 | Dardig | |
| 3,064,367 | A | * | 11/1962 | Henatsch | 36/36 R |
| 3,646,497 | A | | 2/1972 | Gillikin | |
| 3,754,340 | A | * | 8/1973 | Pais | 36/42 |
| 3,797,136 | A | | 3/1974 | Soleri | |
| 3,886,674 | A | | 6/1975 | Pavia | |
| 4,363,177 | A | | 12/1982 | Boros | |
| 4,610,100 | A | | 9/1986 | Rhodes | |
| 4,667,421 | A | | 5/1987 | Rouhani | |
| 4,670,996 | A | | 6/1987 | Dill | |
| 4,942,677 | A | | 7/1990 | Flemming et al. | |
| 5,025,574 | A | | 6/1991 | Lasher, III | |
| 5,347,730 | A | | 9/1994 | Rodriguez Colon | |
| 5,373,649 | A | | 12/1994 | Choi | |
| 5,456,026 | A | | 10/1995 | Lewis | |
| 5,519,950 | A | * | 5/1996 | Wang | 36/42 |
| 5,524,365 | A | | 6/1996 | Goldenberg | |
| 5,615,497 | A | | 4/1997 | Meschan | |

(Continued)

FOREIGN PATENT DOCUMENTS

FR 2 611 451 9/1988

(Continued)

*Primary Examiner* — Ted Kavanaugh
(74) *Attorney, Agent, or Firm* — Plumsea Law Group, LLC

(57) ABSTRACT

An article of footwear includes a group of interchangeable heels. Each heel in the group may be removably associated with the article of footwear. A finger-operable locking mechanism prevents a heel that has been secured to the article of footwear from unintentionally moving toward a toe region. Similarly, a tab positioned at the rear of the article of footwear inhibits a heel that has been secured to the article of footwear from unintentionally moving away from the toe region.

20 Claims, 15 Drawing Sheets

U.S. PATENT DOCUMENTS

| | | | | |
|---|---|---|---|---|
| 5,692,322 | A | 12/1997 | Lombardino | |
| 5,797,199 | A | 8/1998 | Miller et al. | |
| 5,799,417 | A | 9/1998 | Burke et al. | |
| 6,023,859 | A | 2/2000 | Burke et al. | |
| 6,711,835 | B1 | 3/2004 | Militello | |
| 7,168,184 | B2 | 1/2007 | Wallin et al. | |
| 7,185,448 | B2 | 3/2007 | Schupbach | |
| 7,578,075 | B1 * | 8/2009 | Kemp | 36/100 |
| 2001/0052195 | A1 | 12/2001 | Blakey | |
| 2004/0128860 | A1 | 7/2004 | Smaldone et al. | |
| 2005/0252038 | A1 | 11/2005 | Braunschweiler | |
| 2006/0112592 | A1 | 6/2006 | Leedy et al. | |
| 2007/0011909 | A1 | 1/2007 | Palmeri, III | |
| 2007/0256330 | A1 * | 11/2007 | Wallin et al. | 36/102 |
| 2008/0034620 | A1 | 2/2008 | Gallegos | |

FOREIGN PATENT DOCUMENTS

| | | |
|---|---|---|
| GB | 2 420 687 | 6/2006 |
| JP | 10-215914 | 8/1998 |
| JP | 2001-314206 | 11/2001 |
| WO | WO 96/13995 | 5/1996 |

* cited by examiner

ARTICLE OF FOOTWEAR WITH INTERCHANGEABLE HEELS

BACKGROUND

The present invention relates generally to an article of footwear having interchangeable heels, and more particularly to an article of footwear configured to receive any one of a group of heels so that a wearer may select a heel for an intended activity.

It has long been the case that people wear different shoes for different activities: dress shoes for business or more formal occasions, casual shoes for every day, athletic shoes for the gym or sports, and specialized shoes for specialized activities. However, in daily life, the different activities are not necessarily distinctly separated, and a person is often faced with wearing a shoe designed for one activity while participating in another activity. For example, women in business often wear high-heeled dress shoes to work. However, during her commute to and from work, a woman may desire to wear a shoe that is more comfortable and more supportive to the feet while walking or running, such as athletic shoes. A woman may, therefore, carry spare shoes with her in her bag or maintain a supply of shoes in her work space in order to have appropriate shoes for work and the commute. Additionally, a woman may be faced with wearing walking shoes with a business-oriented or formal outfit, so she may not always be presenting herself as she would wish to do. Therefore, some women may choose to commute or otherwise walk long distances, uncomfortably, in high heels, particularly if the woman is carrying a small evening bag into which a spare pair of shoes will not fit.

Some solutions have been put forth for articles of footwear that can cross usage lines. For example, some manufacturers market high heels or formal-looking footwear that are designed to be worn comfortably while walking or even running. Another proposed solution is to have articles of footwear where different heels may be attached to a single upper so that a wearer can select While there are articles of footwear having interchangeable heels, there exists a need in the art for features that improve the characteristics of articles of footwear with interchangeable heels.

SUMMARY OF THE INVENTION

An article of footwear includes a group of heels, were each heel in the group may be interchangeably associated with an upper to form the article of footwear. The upper includes a locking mechanism to retain a heel in position on the article of footwear. The upper also includes a tab configured to engage with a slot formed on each heel in the group of heels.

In one aspect, the invention provides an article of footwear comprising an upper configured to receive any of a group of heels, a locking mechanism disposed on the upper configured to retain a heel in position until intentionally removed by a user, the locking mechanism including a base and a vertical surface, and wherein the vertical surface is configured to abut a leading edge of the heel.

In another aspect, the invention provides a footwear system comprising an upper having a toe region and a heel region, a heel receiving surface disposed on the upper, a first protruding member extending away from the heel engaging surface, a first receiving portion disposed on a first heel, the first receiving portion configured to engage with the first protruding member, a second receiving portion disposed on a second heel, the second receiving portion configured to engage with the first protruding member, the heel receiving surface including a tab, wherein the tab is positioned at a point on the heel region furthest from the toe region, the first heel having a first slot configured to receive the tab, and the second heel having a second slot configured to receive the tab.

In another aspect, the invention provides a footwear system comprising an upper having a toe region and a heel region, a heel receiving surface disposed on the upper, a group of heels configured to be removably attached to the heel receiving surface, a locking mechanism disposed on the heel receiving surface, the locking mechanism comprising a spring and a vertical surface, wherein the spring is compressed into the upper to release the locking mechanism, and wherein the vertical surface is configured to abut a corresponding surface on each heel in the group of heels.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The disclosed embodiments of the invention can be better understood with reference to the following drawings and description. The components in the figures are not necessarily to scale, emphasis instead being placed upon illustrating the principles of the disclosed embodiments of the invention. Moreover, in the figures, like reference numerals designate corresponding parts throughout the different views.

DETAILED DESCRIPTION

An article of footwear is provided with a plurality of interchangeable heels. A user may select a heel so that the article of footwear may be tailored to a particular look or type of activity.

Figure 1:
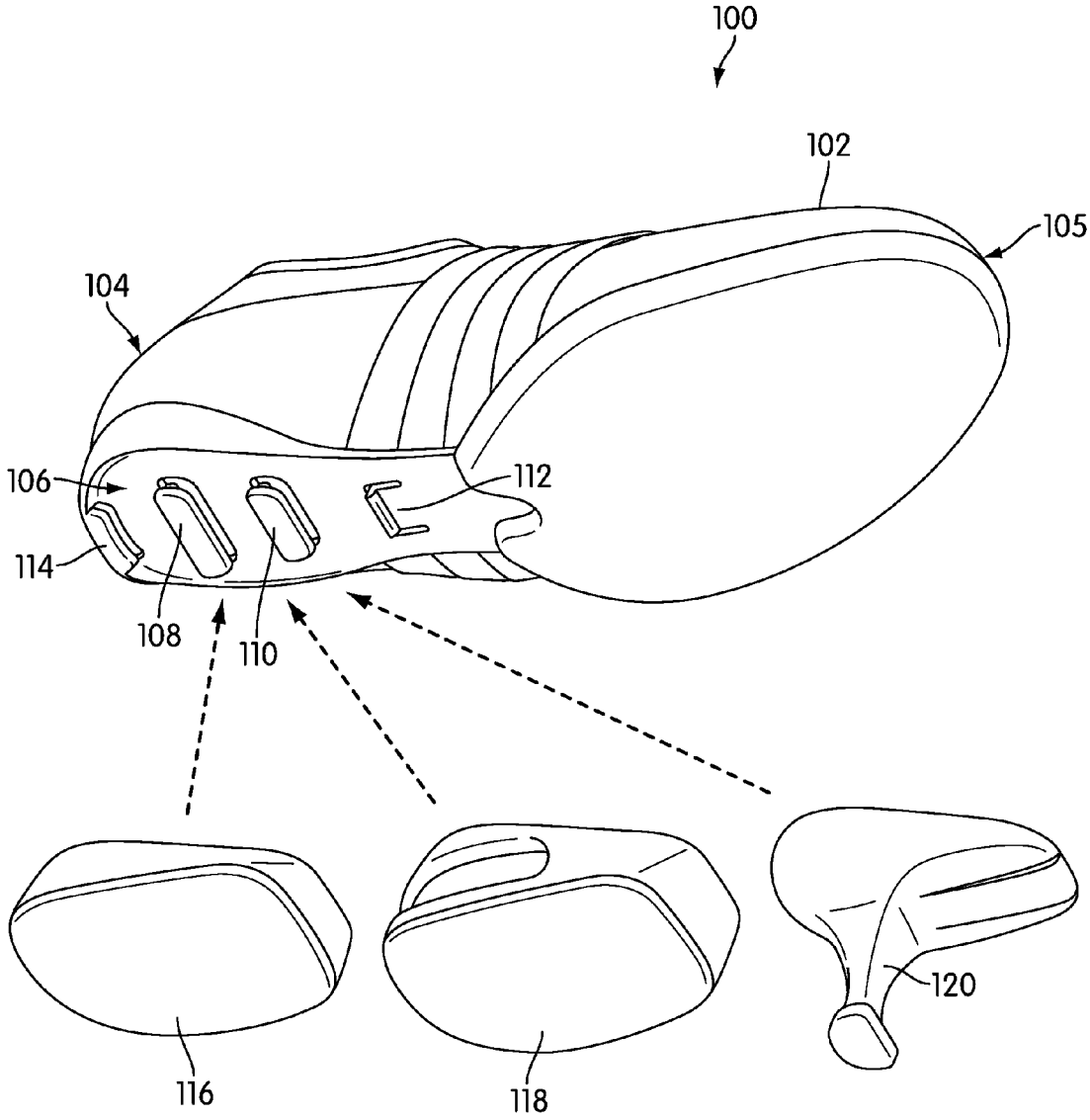
FIG. 1 is a perspective view of an embodiment of an article of footwear configured to receive any of a group of interchangeable heels.
Figure 2:
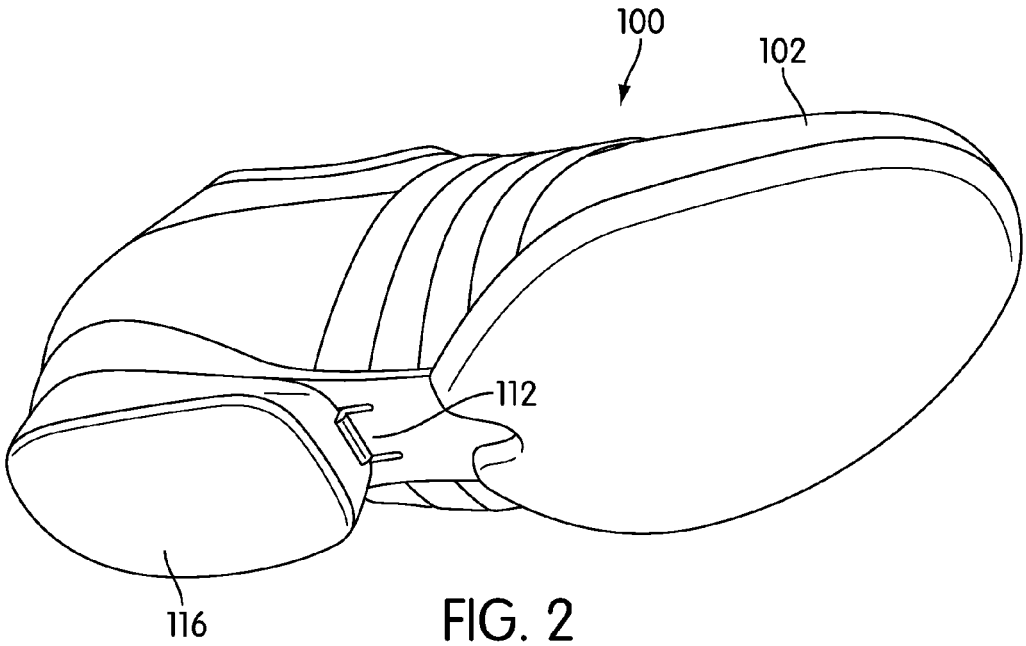
FIG. 2 is a perspective view of an embodiment of an article of footwear having received a first embodiment of a heel selected from a group of interchangeable heels.
Figure 3:
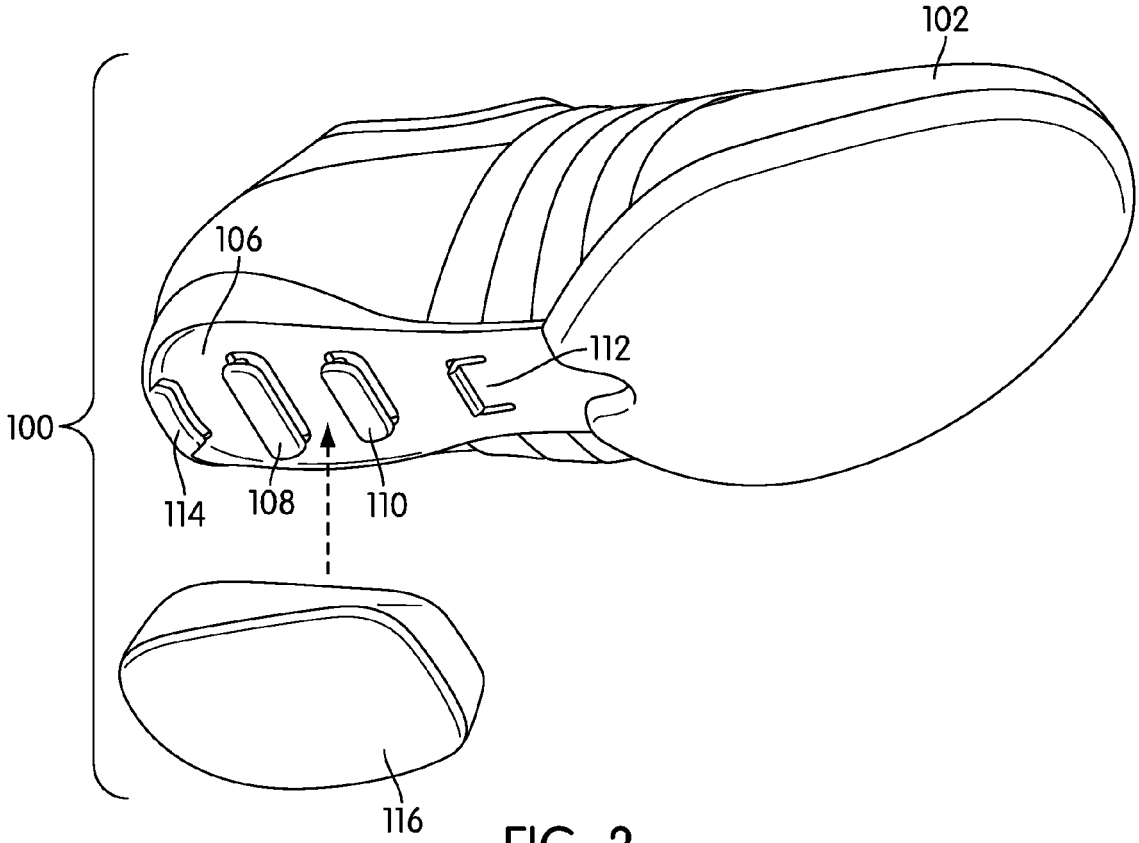
FIG. 3 is an exploded perspective view of an embodiment of an article of footwear having received a first embodiment of a heel selected from a group of interchangeable heels.
Figure 4:
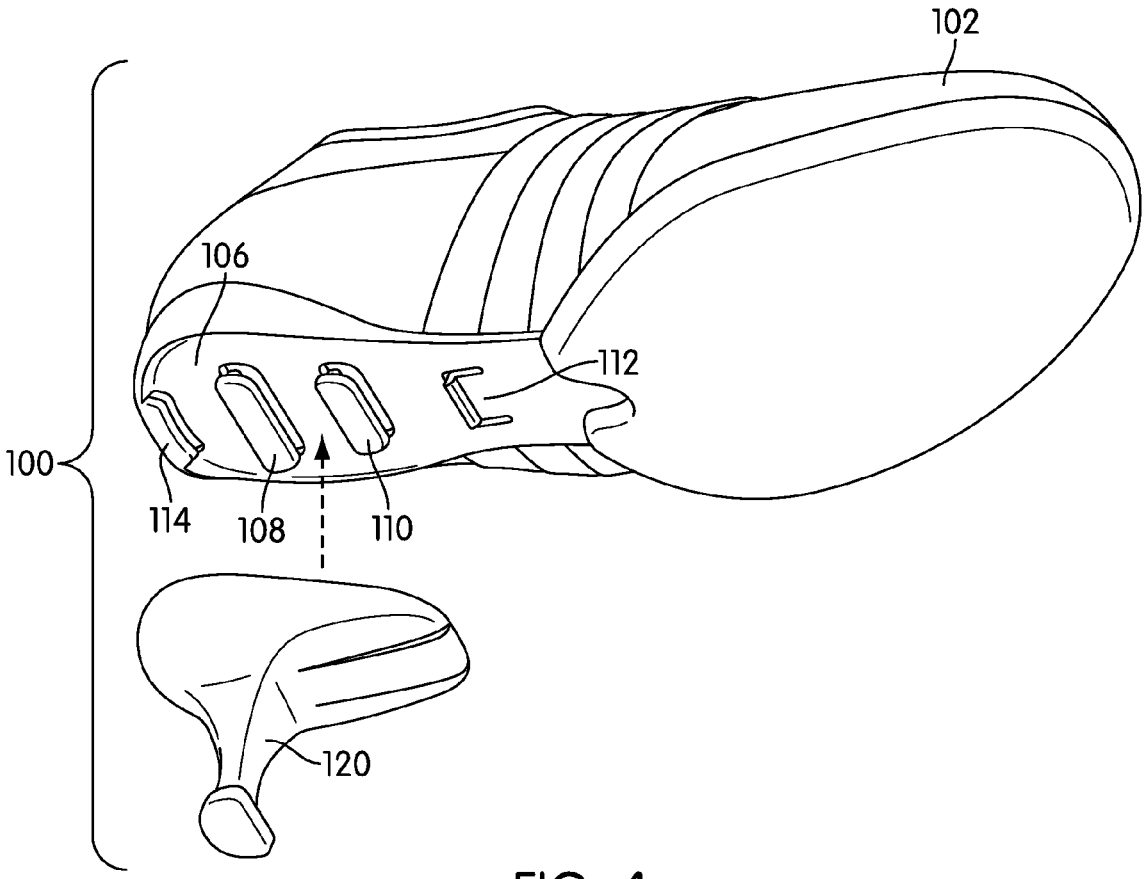
FIG. 4 is an exploded perspective view of an embodiment of an article of footwear having received a second embodiment of a heel selected from a group of interchangeable heels.
Figure 5:
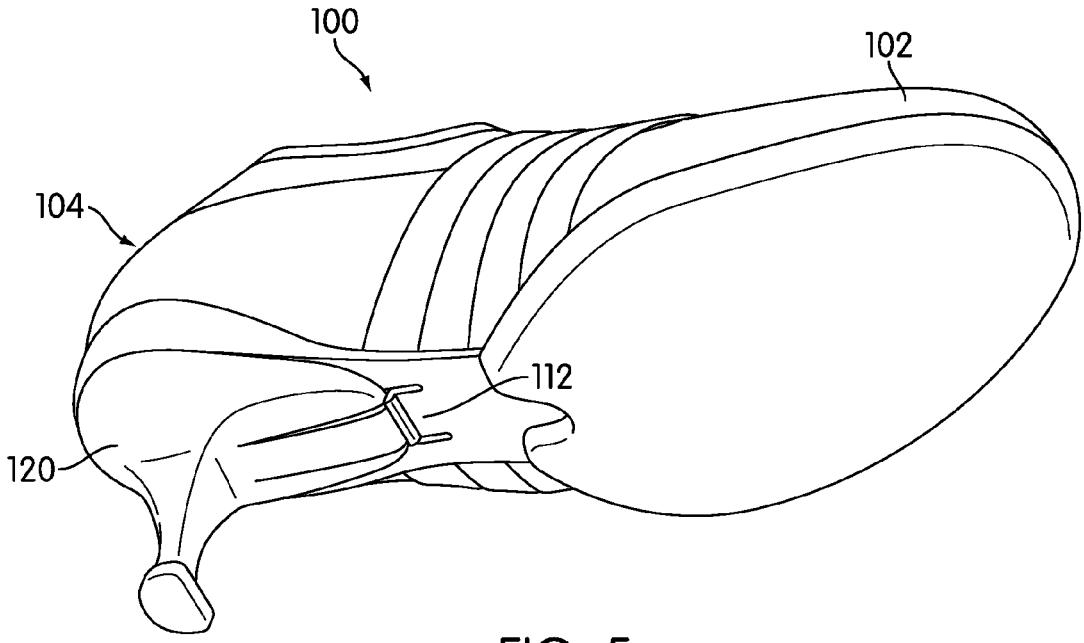
FIG. 5 is a perspective view of an embodiment of an article of footwear having received a first embodiment of a heel selected from a group of interchangeable heels.

FIG. 1 shows one embodiment of an article of footwear 100 having an upper 102 configured to receive any one of a group of interchangeable heels. Upper 102 may be any type of upper known in the art. Upper 102 is depicted as having a substantially conventional configuration incorporating a plurality of material elements (e.g., textiles, foam, leather, and synthetic leather) that are stitched or adhesively bonded together to form an interior void for securely and comfortably receiving a foot. Given that various aspects of the present application primarily relate to the interchangeable heels, upper 102 may exhibit the general configuration discussed above or the general configuration of practically any other conventional or non-conventional upper. Accordingly, the structure of upper 102 utilized with the interchangeable heels or variants thereof may vary significantly.

The group of interchangeable heels may contain any number of heels, with each heel providing a different look, a different level of support, and/or are tailored to different activities. In the embodiment shown in FIG. 1, three different heels are provided: a first heel 116, a second heel 118, and a third heel 120. First heel 116 is generally configured as a casual or athletic shoe heel. Second heel 118 is generally configured as a casual or athletic shoe heel containing a cushioning airbag. Third heel 120 is generally configured as a high heel, shown in the figures as a "kitten" heel. The shapes and styles shown in the figures are meant to be representative only, and other shapes, styles, and/or configurations of the different heels in the group may be provided.

As shown in FIGS. 1-6, any of the three heels 116, 118, and 120 may be interchangeably associated with upper 102. Upper 102 includes provisions in a heel region 104 to associate heels 116, 118, and 120 with upper 102. In some embodiments, these provisions generally include a heel engagement plate 106 disposed in heel region 104 and one or more protruding members configured to engage with heels 116, 118, and 120. In the embodiment shown in the figures, heel engagement plate 106 includes a first protruding member 108 and a second protruding member 110. In other embodiments, any number of protruding members may be provided, from one to three or more.

Heel engagement plate 106 generally provides a smooth surface onto which heels 116, 118, and 120 may be passed over in order to attach heels 116, 118, and 120 to upper 102. Heel engagement plate 106 may, in some embodiments, be relatively stiff and durable so that repeatedly attaching and removing heels 116, 118, and 120 to upper 102 does not cause significant deterioration of heel engagement plate 106. In some embodiments, heel engagement plate 106 may be formed from any rigid material, i.e., a stiff material that is generally not pliable or flexible. Heel engagement plate 106 may be made from a plastic material, a metal, or a composite material. Heel engagement plate 106 may be attached to upper 102 using any method known in the art, such as with an adhesive, co-forming, over-molding, stitching, or the like.

Heel engagement plate 106 also forms an anchoring surface for the heel attachment provisions, first protruding member 108 and second protruding member 110. Protruding members 108 and 110 generally extend away from the surface of heel engagement plate 106 and away from upper 102. Protruding members 108 and 110 may be generally rigid members formed of a similar material to that of heel engagement plate 106. In some embodiments, such as those shown in the figures, protruding members 108 and 110 are integrally formed with heel engagement plate 106, such as by molding. In other embodiments, protruding members 108 and 110 may be associated with heel engagement plate 106, such as with mechanical fasteners such as screws, with adhesives, or with any other method known in the art.

Figure 6:
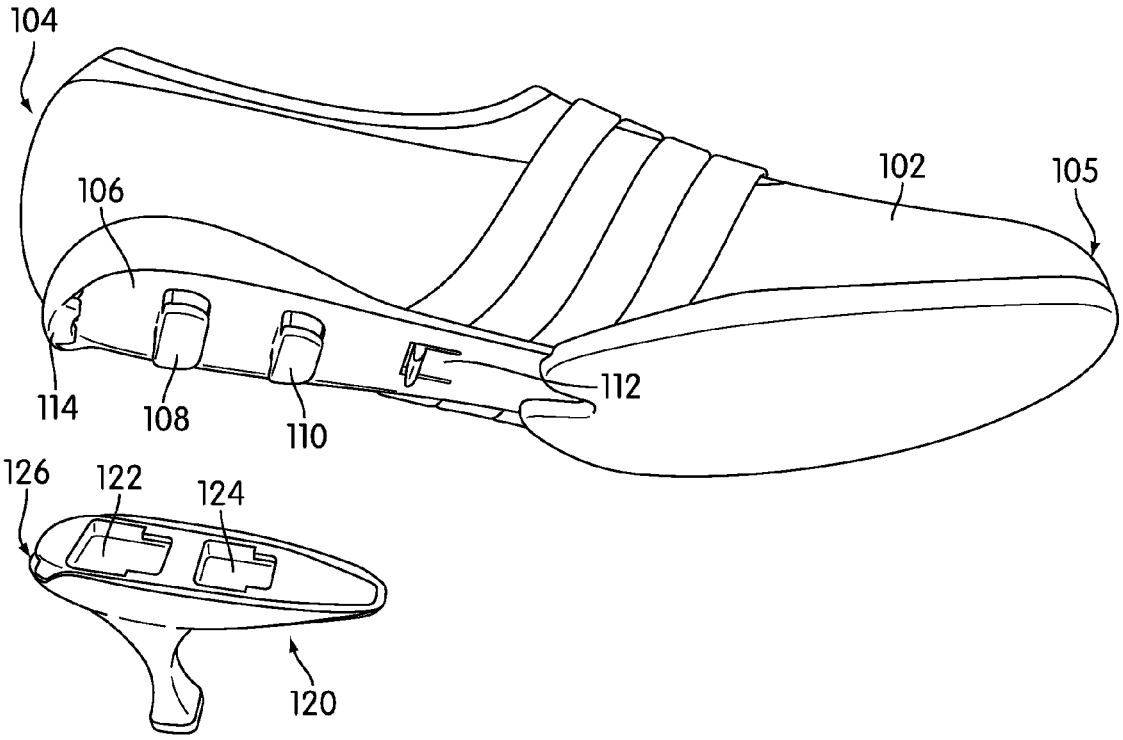
FIG. 6 is an exploded perspective view of an embodiment of an article of footwear having received a second embodiment of a heel selected from a group of interchangeable heels.

As shown in FIG. 6, protruding members 108 and 110 may be generally configured to be inserted into corresponding receiving compartments 122 and 124 formed on heels 116, 118, and 120. These receiving compartments 122 and 124 are sized and shaped to receive protruding members 108 and 110. Because heels 116, 118, and 120 are interchangeable with each other, each heel in the group of heels includes similarly shaped and sized receiving compartments 122 and 124. In other words, all of the heels in the group of heels capable of being associated with upper 102 include receiving compartments 122 and 124 keyed to receive protruding members 108 and 110.

Figure 8:
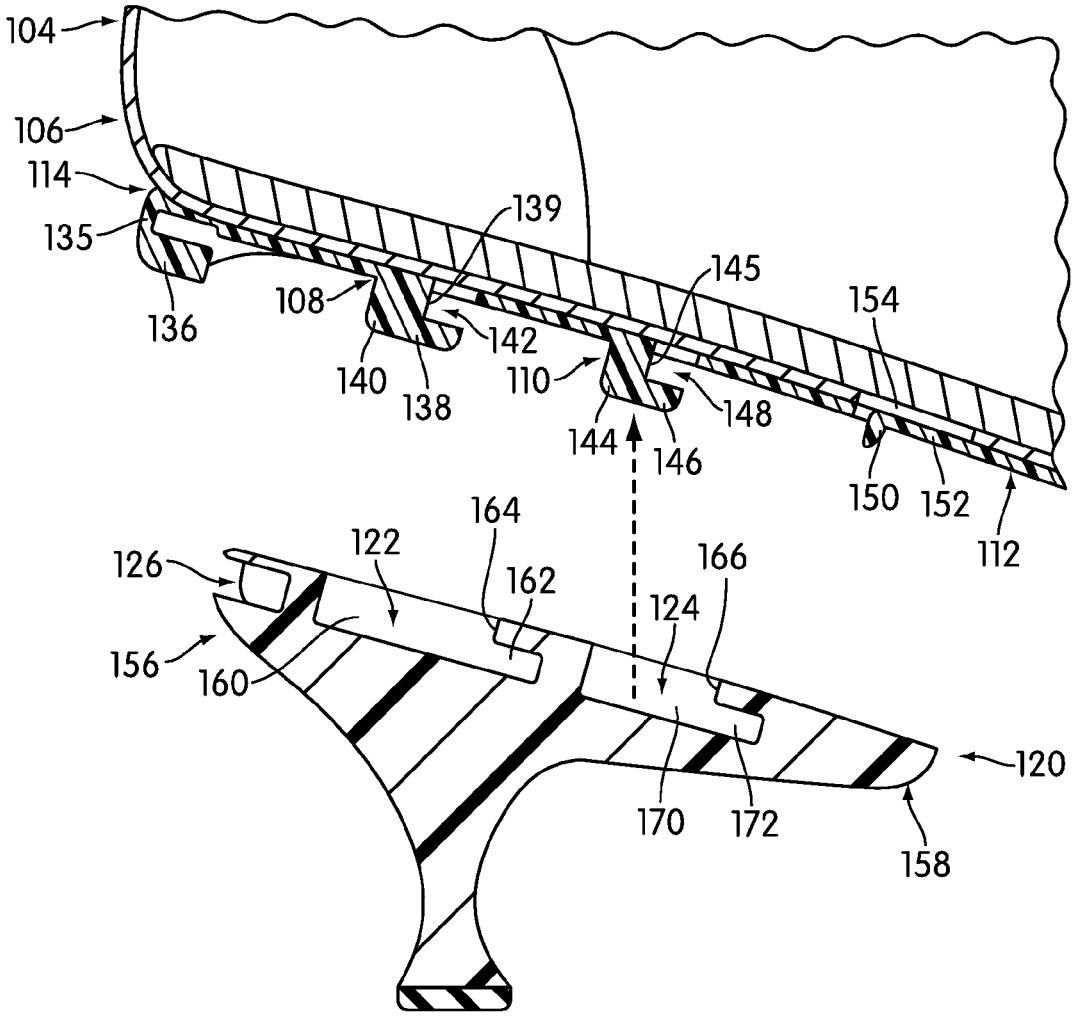
FIG. 8 is a cross-sectional view of the article of footwear shown in FIG. 7 showing the alignment of the attachment mechanisms of the article of footwear and the second embodiment of a heel.

FIG. 8 shows one embodiment of the shape of protruding members 108 and 110 and the corresponding shape of receiving compartments 122 and 124. In the embodiment shown in FIG. 8, protruding members 108 and 110 have generally the same or a similar shape. In other embodiments, protruding members 108 and 110 may have different shapes so that a heel such a heel 120 may be associated with upper 102 in only one orientation. For clarity, only protruding member 108 and receiving compartment 122 will be described.

Protruding member 108 may generally have an L-shape: a stem 140 and an extension 138. In some embodiments, stem 140 and extension 138 may be integrally formed. In other embodiments, extension 138 may be attached or affixed to stem 140. In some embodiments, extension 138 is generally parallel to heel engagement plate 106 while stem 140 is generally perpendicular to heel engagement plate 106. In other embodiments, stem 140 may be positioned at an acute or obtuse angle to heel engagement plate 106 while extension 138 may be angled toward or away from heel engagement plate 106.

Stem 140 generally holds extension 138 a certain distance away from heel engagement plate 106. Extension 138 extends away from stem 140 toward a toe region 105 of article of footwear so that a gap 142 is formed. Gap 142 is defined by extension 138, stem 140, and the surface of heel engagement plate 106. Gap 142 is generally configured to receive a portion of receiving portion 122 when a heel like heel 120 is associated with heel engagement plate 106.

Figure 10:
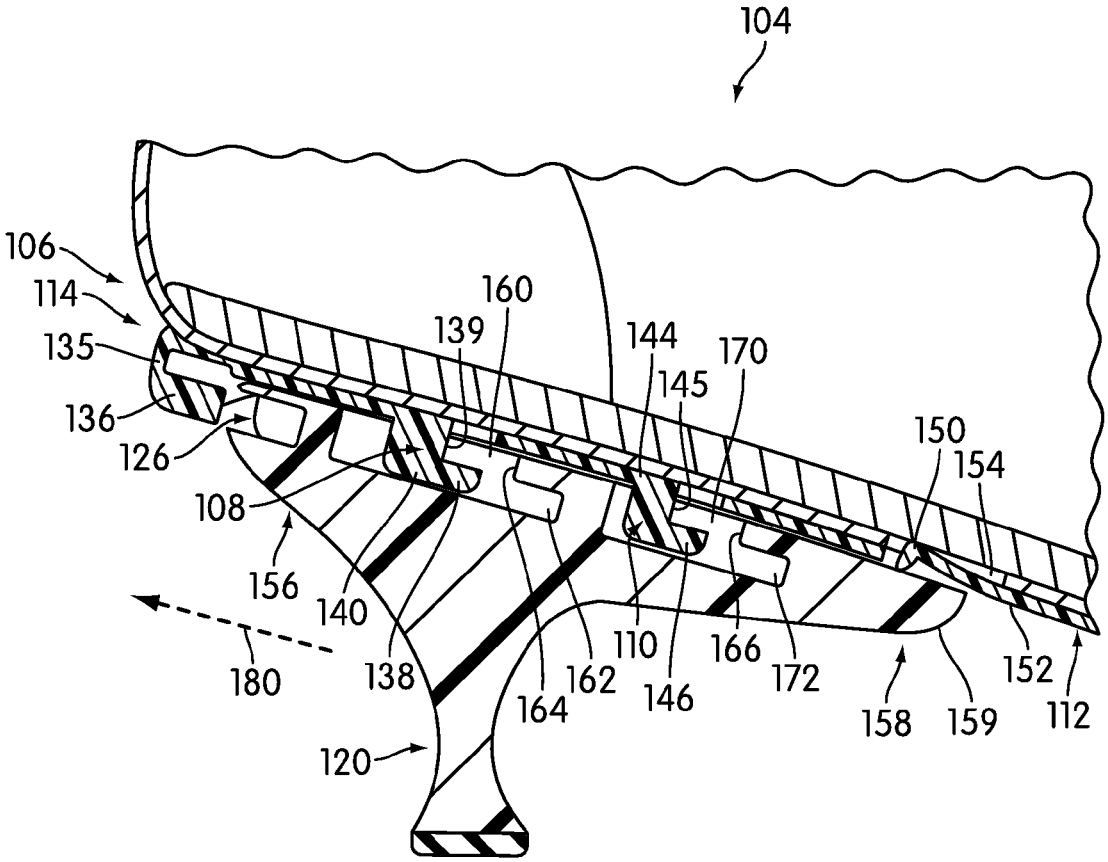
FIG. 10 is a cross-sectional view of the article of footwear shown in FIG. 9 showing the initial insertion of the attachment mechanisms of the article of footwear into the heel.

Receiving portion 122 is generally configured so that protruding member 108 may be inserted into receiving portion 122. In some embodiments, such as those shown in the figures, receiving portion 122 may be configured so that protruding member 108 may be inserted into a first section of receiving portion 122 and then moved into a second section of receiving portion 122 to secure protruding member 108 within receiving portion 122. As shown in FIG. 8, receiving portion 122 includes an insertion chamber 160 and a securing chamber 162. Insertion chamber 160 is relatively large and open so that extension 138 may be completely and readily positioned within insertion chamber 160, as shown in FIG. 10.

Figure 14:
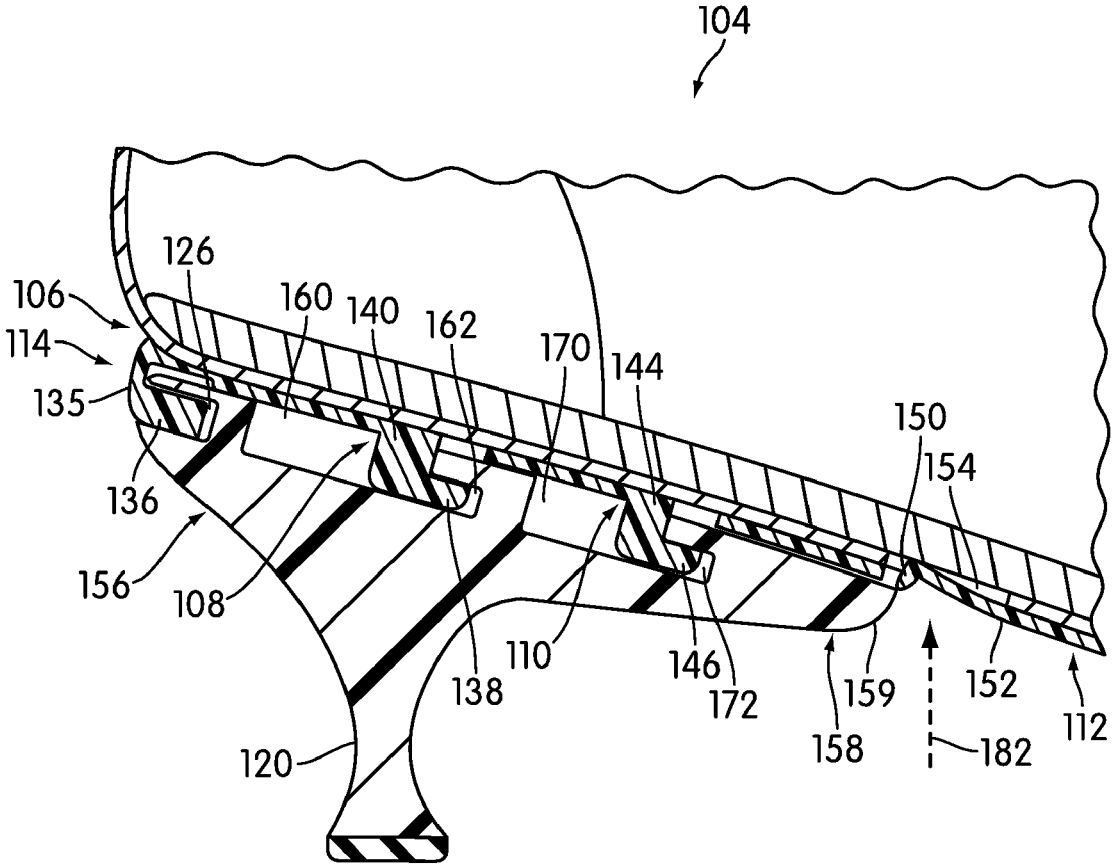
FIG. 14 is a partial cross-sectional view of the article of footwear shown in FIG. 13.

In contrast, securing chamber 162 is relatively small and includes a lip 164. Lip 164 is configured to prevent extension 138 from being lifted out of securing chamber 162. As shown in FIG. 6, lip 164 may not extend entirely across securing chamber 162. Instead, lip 164 extends from the sides of securing chamber 162 but does not cover the center. This open center portion is configured to accommodate stem 140 when protruding member 108 is positioned within securing chamber 162. As shown in FIG. 14, protruding member 108 may be positioned within receiving chamber 122 so that stem 140 abuts lip 164 and extension 138 is trapped beneath lip 164. Receiving chamber 122 and extension 138 may be sized and dimensioned so that extension 138 is press-fitted or interference-fitted within receiving chamber 122 for a more secure fit.

In addition to protruding members 108 and 110, the attachment provisions on heel receiving plate 106 may also include a locking mechanism 112. Locking mechanism 112 is generally configured to retain the heel associated with heel receiving plate 106 in position until the heel is intentionally released from heel receiving plate. In some embodiments, such as those shown in the figures, locking mechanism 112 is configured to be finger-operated by the user. In other embodiments, locking mechanism 112 may be configured to be operated by a tool, such as a screwdriver, a pencil, or another type of tool either found as a regular household item or provided with article of footwear 100. Even in the embodiments shown in the figures, in which locking mechanism 112 is intended to be operated by the fingers, a user may elect to operate locking mechanism 112 with a tool. For example, a user may wish to avoid breaking a fingernail while attaching or releasing a heel from heel receiving plate 106 or locking mechanism 112 may be stiff and somewhat difficult to operate when article of footwear 100 is new.

As best shown in FIG. 8, locking mechanism 112 generally includes a base 152 and a vertical portion 150 that extends away from base 152 and away from heel receiving portion 106. Base 152 may be a spring, such as a flat cantilever spring or a leaf spring. In other embodiments, base 152 may be a flat portion of material that is spring-loaded to return to a neutral position. In some embodiments, base 152 may be a thin strip of material associated at one end with heel receiving plate 106. In some embodiments, base 152 may be made from the same or a similar material as heel receiving portion 106. For example, both base 152 and heel receiving portion 106 may be made from a molded plastic. In other embodiments, base 152 may be made from other materials. For example, heel receiving portion 106 may be made from a molded plastic material and base 152 may be made from metal. Base 152 may be associated with heel receiving portion 106 using any method known in the art, such as mechanical fasteners like screws, with an adhesive, or co-formed. In some embodiments, base 152 is formed integrally with heel receiving portion, such as in a mold.

Base 152 is generally configured to be pressed into a recess 154 formed in heel receiving plate 106. Locking mechanism 112 is in a locked position when base 152 is not pressed into recess 154 and is in an unlocked position when base 152 is pressed into recess 154. In the embodiments shown in the figures, base 152 has a neutral position in the locked position.

Locking mechanism vertical portion 150 is generally configured to be pressed into recess 154. In a neutral position, vertical portion 150 extends a maximum distance away from a surface of heel receiving plate 106. In this position, vertical portion 150 may act as a stop to prevent a heel attached to heel receiving plate 106 from moving past vertical portion 150 toward toe region 105.

As shown in FIG. 6, heel receiving plate 106 may also be provided with a tab 114. Tab 114 may be positioned on heel receiving plate 106 at a point furthest from a toe region 105. Tab 114 is positioned, sized, and dimensioned to be received by a corresponding slot 126 formed on each heel, shown as heel 120 in FIG. 6. Tab 114 serves a two-fold purpose: aligning tab 114 with slot 126 helps a user position a heel for proper association with heel receiving plate 106 and the association of tab 114 and slot 126 helps to stabilize the heel on heel receiving plate 106. The position of tab 114 and slot 126 at the rear of article of footwear 100 provides particular support of those users who press hard on the heels while walking.

The structure of tab 114 is more clearly shown in FIG. 8. Tab 114 generally includes a wall 135 and a flange 136 that extends away from wall 135. Wall 135 is generally configured as a rearward-most point of heel receiving plate 106. Flange 136 is generally sized and dimensioned to be received by slot 126 on the heels.

Figure 7:
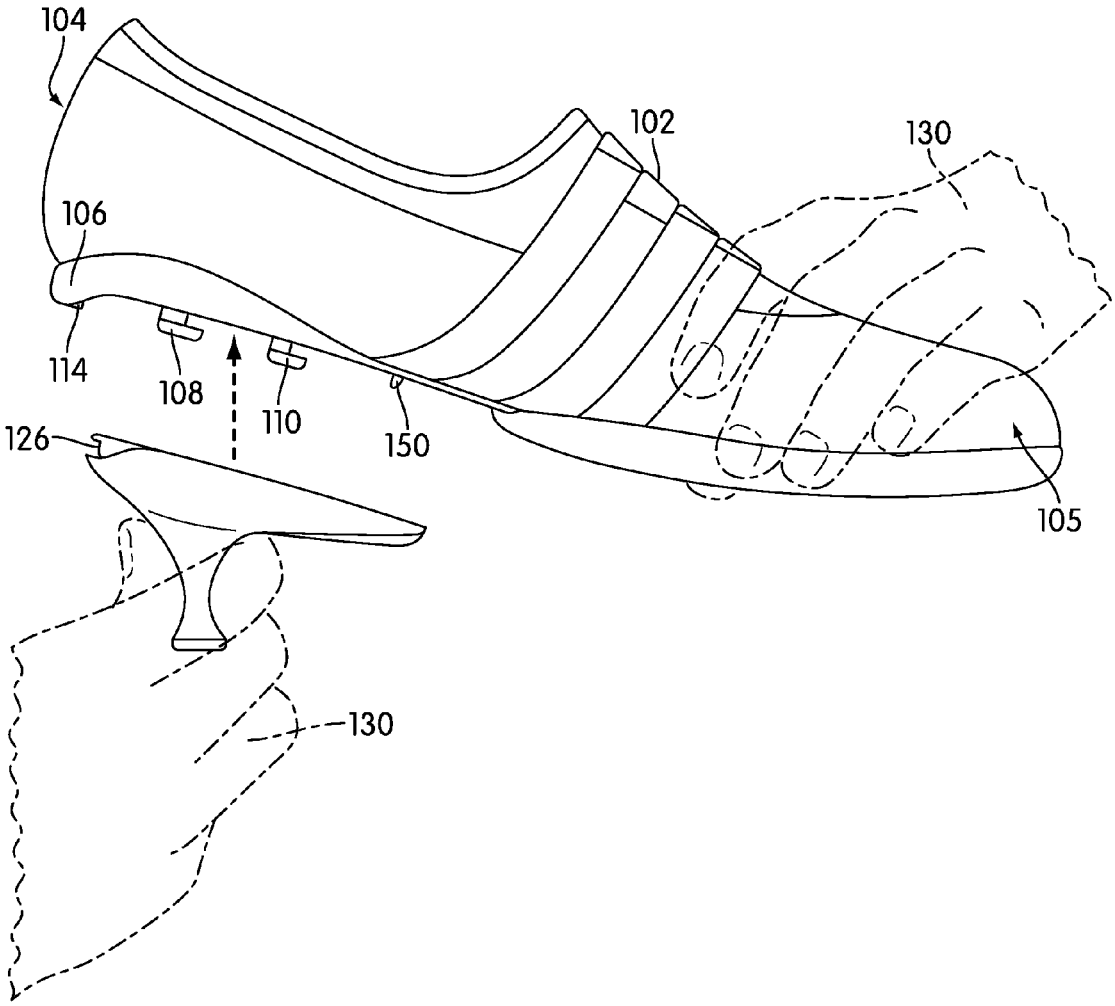
FIG. 7 is a side view of an embodiment of an article of footwear and a second embodiment of a heel selected from a group of interchangeable heels showing how a user may position the article of footwear to receive the second embodiment of a heel.

All of these attachment provisions are aligned in order to associate a heel with heel receiving plate 106. FIGS. 7-12 show one embodiment of how a heel may be associated with upper 102 to complete article of footwear 100. First, a heel is selected from the group of heels. In this embodiment, the group of heels includes first heel 116, second heel 118, and third heel 120, as shown in FIG. 1. As shown in FIG. 7, a user has selected third heel 120 to associate with upper 102. However, any of the heels may be chosen, and third heel 120 is being shown here for demonstrative purposes only. All of the heels may be associated with upper 102 in a similar fashion.

The user grasps upper 102 in one hand 130 and third heel 120 in the opposite hand 130. At this point, the user aligns protruding members 108 with receiving portions 122 and 124, respectively, to prepare to begin associating third heel 120 with upper 102. This alignment is most clearly shown in FIG. 8. FIG. 8 also shows how heel 120 is positioned slightly toward toe region 105 (shown in FIG. 7). This positioning aligns extension 138 of first protruding member 108 with insertion chamber 160 of first receiving portion 122. Similarly, second extension 146 of second protruding member 110 is aligned with second insertion chamber 170 of second receiving portion 124. Additionally, tab 114 is positioned to clear the rearward-most part of third heel 120 so that tab 114 does not interfere with the initial connection of third heel 120 to heel receiving plate 106. Finally, at this point, locking mechanism 112 on heel receiving plate 106 is in a neutral position so that base 152 follows the contours of the surface of heel receiving plate 106 and vertical portion 150 is fully extended away from the surface of heel receiving plate 106.

Figure 9:
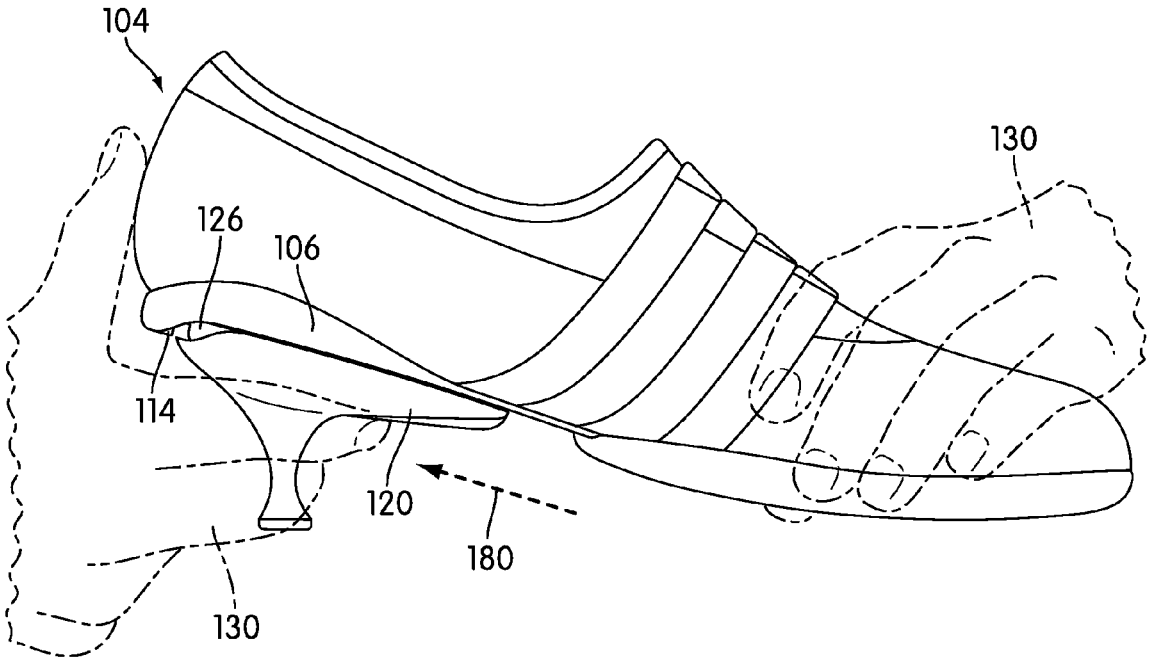
FIG. 9 is a side view of an embodiment of an article of footwear and a second embodiment of a heel selected from a group of interchangeable heels showing how a user may position the heel on the article of footwear prior to securing the heel to the article of footwear.

FIGS. 9 and 10 show a second step in the process of associating third heel 120 with upper 102. At this point, the user's hands 130 have pressed third heel 120 against heel receiving plate 106 in the direction indicated by the arrows. First and second protruding members 108 and 110 have been positioned within insertion chambers 160 and 162, respectively. An upper surface of third heel 120 is pressed flush against the surface of heel receiving plate 106. Tab 114 is aligned with third heel 120 so that flange 136 of tab 114 is positioned to be inserted into slot 126 on third heel 120.

In this position, a front portion 158 of third heel 120 presses against locking mechanism 112. Front portion 158 pushes against vertical portion 150 so that base 152 bends. Vertical portion 150 and at least a portion of base 152 are rotated into cavity 154. In this manner, locking mechanism 112 is positioned so as not to interfere with the attachment of third heel 120 onto heel receiving plate 106. As indicated by the arrows, the user may begin to push third heel 120 toward the rear of article of footwear 100 to secure third heel 120 to upper 102.

Figure 11:
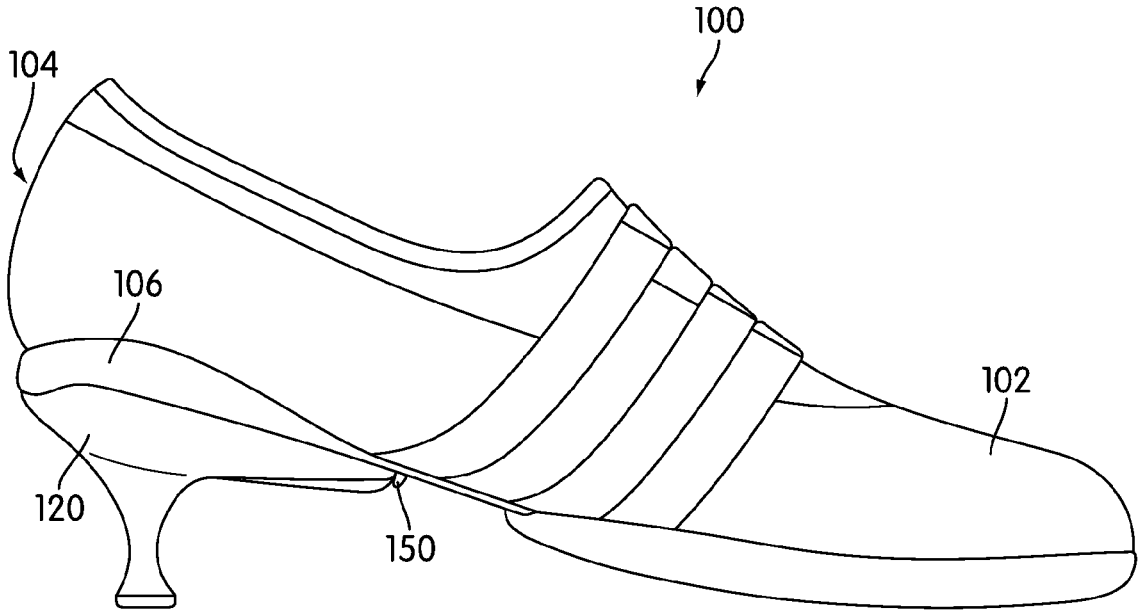
FIG. 11 is a side view of an embodiment of an article of footwear and a second embodiment of a heel selected from a group of interchangeable heels showing the heel in a fully inserted positioned.
Figure 12:
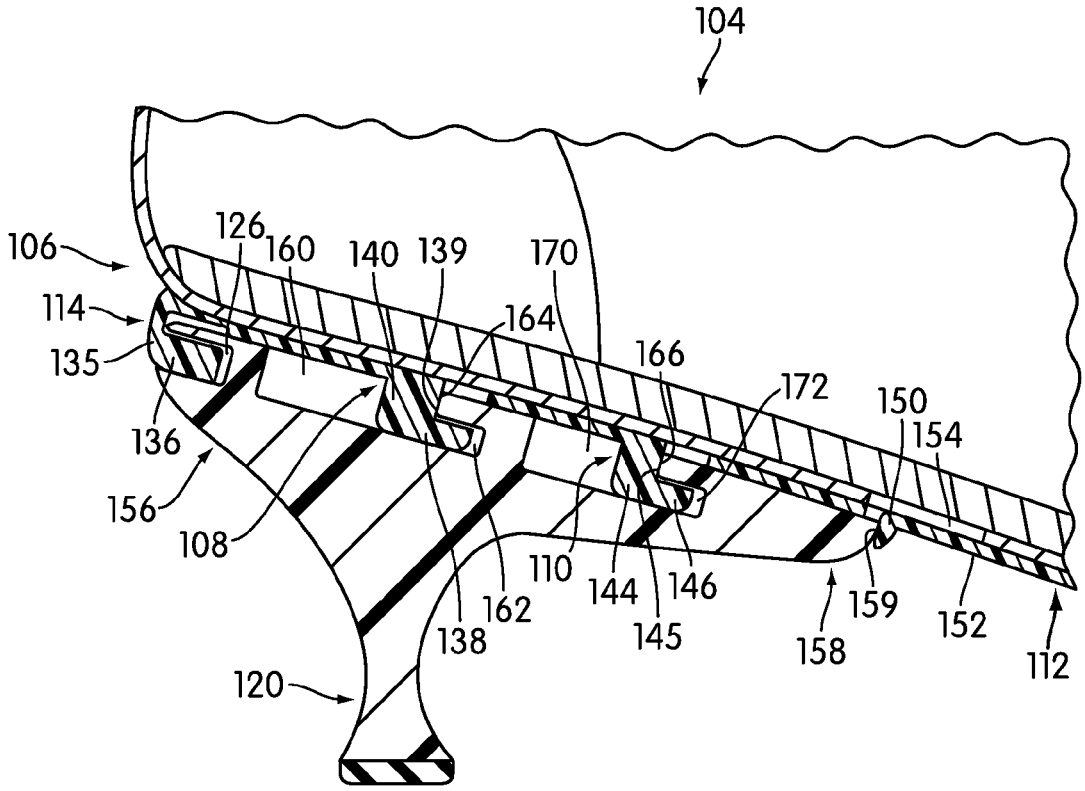
FIG. 12 is a partial cross-sectional view of the article of footwear shown in FIG. 11 showing the interlocking of the attachment mechanisms of the article of footwear and the heel when the heel is in a fully inserted position.

FIGS. 11 and 12 show third heel 120 in the secured position. Third heel 120 has been pushed rearward so that flange 136 of tab 114 fully inserted into slot 126 of third heel 120. Similarly, protruding members 108 and 110 have been moved into securing chambers 162 and 172, respectively. Lip 164 abuts a front surface 139 of stem 140. A second lip 166 of second securing chamber 172 abuts a second front surface 145 of a second stem 144 of second protruding member 110.

At this point, a front edge 159 of third heel 120 has been moved past locking mechanism 112. Therefore, third heel 120 is no longer pressing locking mechanism 112 into cavity 154. Base 152, which is a cantilever spring in this embodiment, releases its stored energy and returns to its neutral position. In its neutral position, base 152 generally follows the contours of the surface of heel receiving plate 106 and vertical portion 150 extends a maximum length away from the surface of heel receiving plate 106. In this position, vertical portion 150 abuts front edge 159 of third heel 120. Vertical portion 150 acts as a stop to prevent third heel 120 from moving toward toe region 105 (shown in FIG. 6). Therefore, until vertical portion 150 is moved so that front edge 159 can clear vertical portion 150, third heel 120 remains locked into this position.

Figure 13:
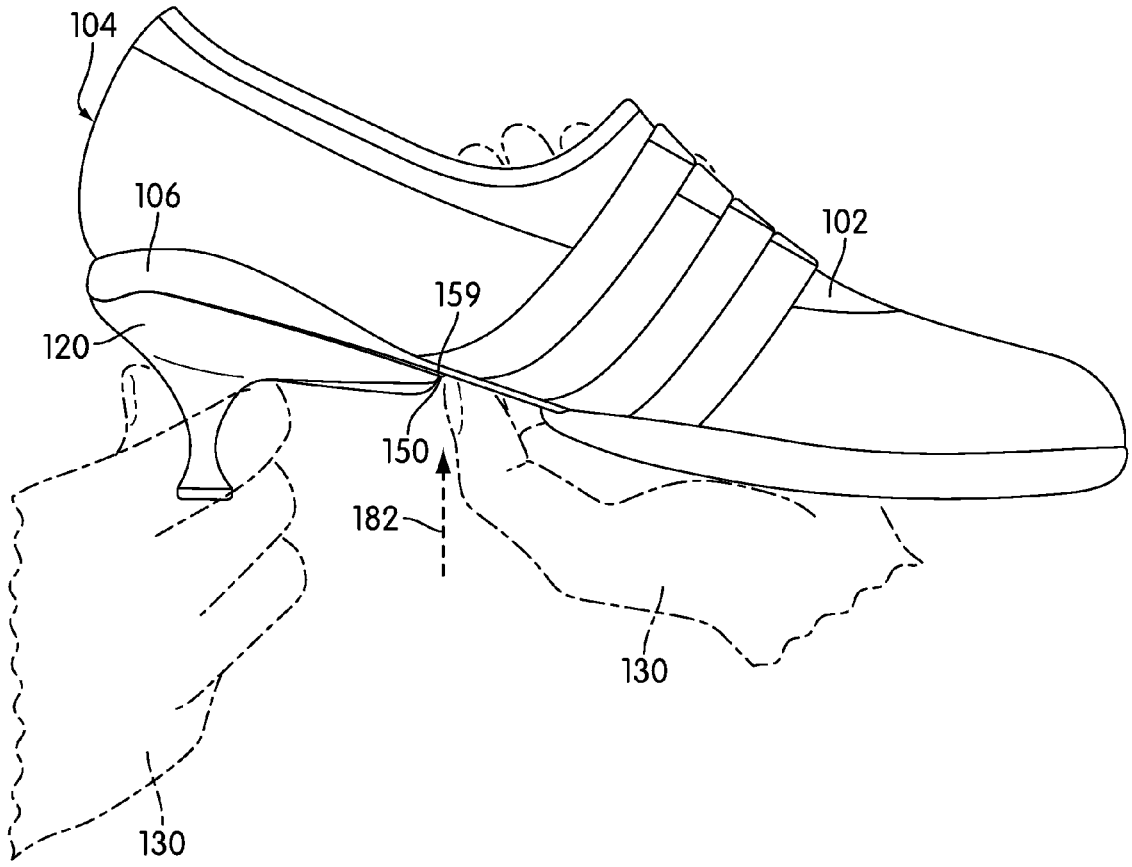
FIG. 13 is a side view of an embodiment of an article of footwear and a second embodiment of a heel selected from a group of interchangeable heels showing how a user initially releases the heel from the article of footwear.

FIGS. 13-17 show one embodiment of how third heel 120 may be detached from upper 102. FIGS. 13 and 14 show the first step in removing third heel 120 from heel receiving plate 106. As discussed above, locking mechanism 112 holds third heel 120 in position on heel receiving plate 106 by abutting vertical portion 150 against front edge 159 of third heel 120. A user may rotate vertical portion 150 and a portion of base 152 into cavity 154 to release third heel 120 from heel receiving plate 106. As shown in FIG. 13, a user may press against vertical portion 150 and/or base 152 with a finger or thumb in the direction indicated by arrow 182. In other embodiments, a user may employ a tool to press against locking mechanism 112. The pressure exerted by the user on locking mechanism 112 causes vertical portion 150 and a portion of base 152 to rotate into cavity 154. As vertical portion 150 rotates into cavity 154, eventually vertical portion 150 is sufficiently inserted into cavity 154 so that front edge 159 of third heel 120 may be moved past vertical portion 150. It should be noted that a user would typically continue to press against vertical portion 150 as the other hand moves third heel 120 toward, and eventually, over, vertical portion 150.

Figure 15:
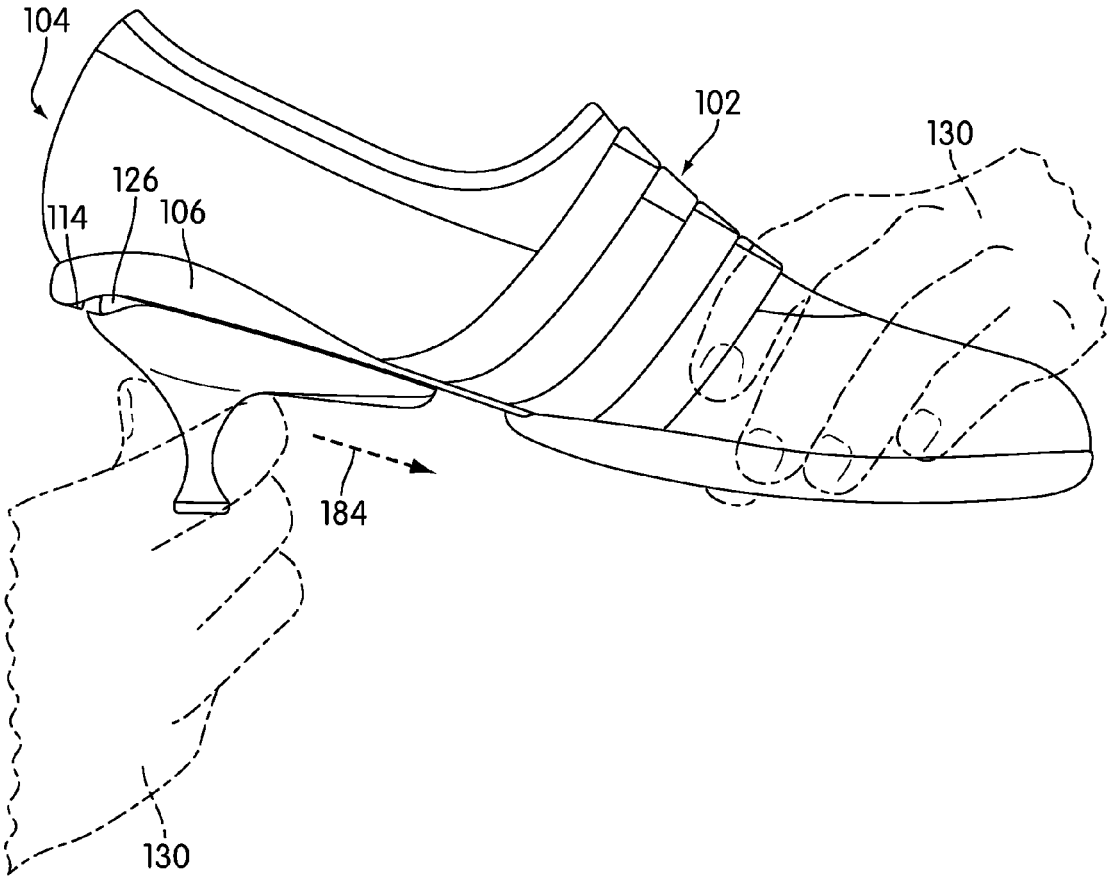
FIG. 15 is a side view of an embodiment of an article of footwear and a second embodiment of a heel selected from a group of interchangeable heels showing how a user removes the heel from the article of footwear.
Figure 16:
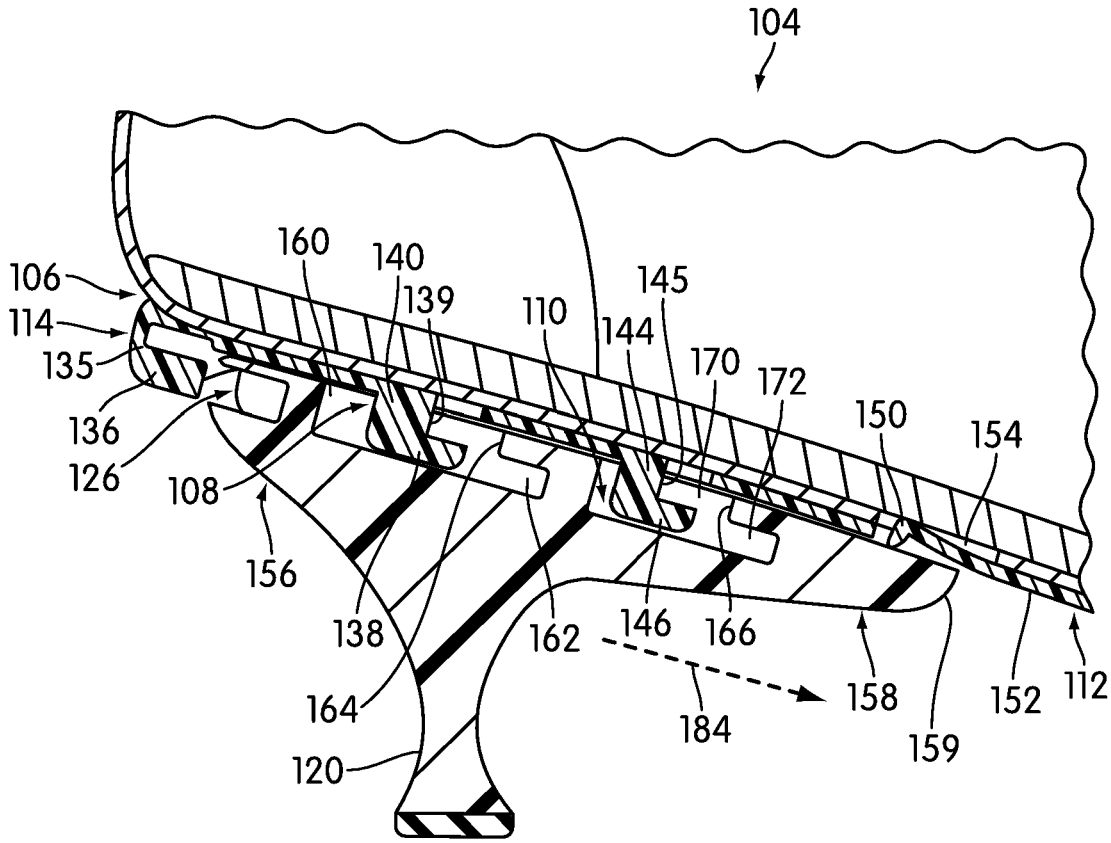
FIG. 16 is a partial cross-sectional view of the article of footwear shown in FIG. 15.

A second step in the removal or detachment process is shown in FIGS. 15 and 16. This step is essentially a reversal of the insertion step shown in FIGS. 9 and 10. The user grasps upper 102 in one hand 130 and third heel 120 in the other hand 130. Front portion 158 of third heel 120 holds locking mechanism 112 within cavity 154 so that locking mechanism 112 cannot interfere with the removal process.

Third heel 120 is moved in the direction indicated by arrow 184. Tab 114 is extracted from slot 126. First protruding member 108 is moved from securing chamber 162 into insertion chamber 160 by extracting extension 138 from underneath lip 164. Similarly, second protruding member 110 is moved from second securing chamber 172 into second insertion chamber 170 by extracting second extension 146 from underneath second lip 166. Third heel 120 has, therefore, been freed from all provisions intended to secure third heel 120 into position on heel receiving plate 106.

Figure 17:
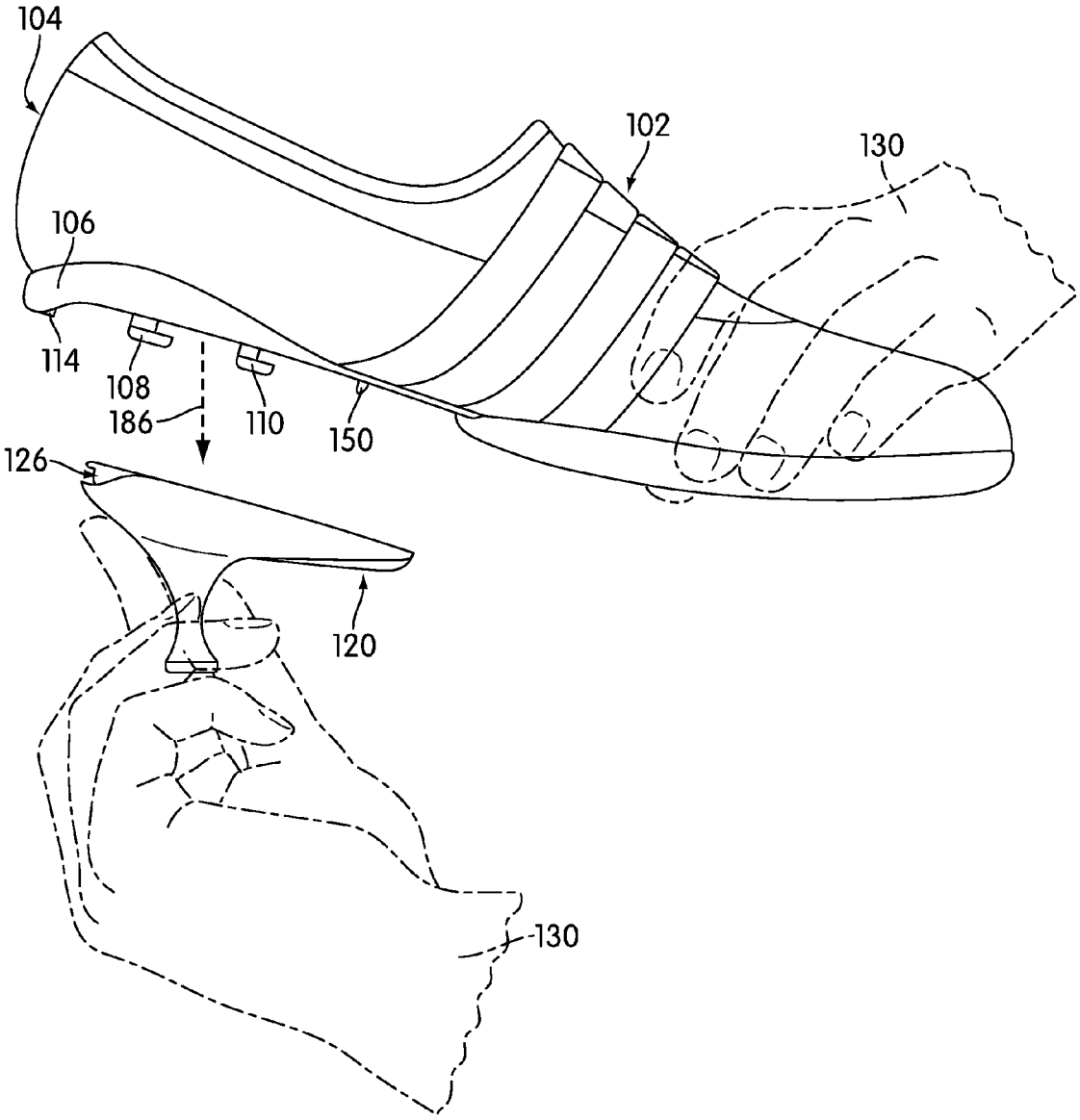
FIG. 17 is a side view of an embodiment of an article of footwear and a second embodiment of a heel selected from a group of interchangeable heels showing the heel fully removed from the article of footwear.

In a final step, as shown in FIG. 17, third heel 120 is lifted away from heel receiving plate 106 in the direction indicated by arrow 186. Pulling or lifting third heel 120 in this direction removes first protruding member 108 from first receiving portion 122 through the open top of insertion chamber 160 (not shown in FIG. 17). Similarly, second protruding member 110 is removed from second receiving portion 124 through the open top of second insertion chamber 170 (not shown in FIG. 17). At this point, vertical portion 150 is returned to the neutral position and extends a maximum distance from the surface of heel receiving plate 106.

In a similar manner as described above, any of the heels of the group of available heels may be interchangeably attached to upper 102 to form any number of configurations for article of footwear 100. Thus, a user is spared the necessity of owning and/or transporting a number of different article of footwear for different occasions. A user may simply maintain a group of heels that may be exchanged for each other depending upon the desired look and/or use of the article of footwear.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising:

an upper configured to receive any of a group of heels, the upper having toe region, a heel region, and a cavity disposed between the toe region and the heel region;

a locking mechanism disposed on the upper and configured to retain a heel in position until intentionally removed by a user;

the locking mechanism including a base configured to bend inwardly into the cavity to release the heel from the upper and a vertical portion protruding outwardly away from the base and the upper;

wherein the vertical portion includes a vertical surface configured to abut a leading edge of the heel;

a tab configured to engage a slot on the heel, wherein the tab is disposed on a rear edge of the heel region such that the heel is positioned between the locking mechanism and the tab when the upper is assembled with the heel;

a first protruding member configured to engage a first receiving portion on the heel, wherein the first protruding member is disposed between the locking mechanism and the tab; and wherein the tab and the first protruding member are substantially the same height.

2. The article of footwear according to claim 1, further comprising a second protruding member configured to engage a second receiving portion on the heel, wherein the second protruding member is disposed between the first protruding member and the locking mechanism.

3. The article of footwear according to claim 2, wherein the first protruding member, the second protruding member, and the tab are substantially the same height.

4. The article of footwear according to claim 1, wherein the tab includes a wall extending away from the upper and a flange extending from the wall toward the toe portion, the flange having a width that is less than the width of the upper.

5. The article of footwear according to claim 1, further comprising:

a heel engaging plate disposed on the upper; and wherein the first protruding member includes a stem extending away from the heel engaging plate and an extension extending from the stem toward the toe portion; and wherein the tab includes a wall extending away from the heel engaging plate and a flange extending from the wall toward the toe portion.

6. The article of footwear according to claim 5, wherein the first receiving portion includes an insertion chamber and a securing chamber, and wherein the insertion chamber is contiguous with the securing chamber so that the first protruding member is configured to be initially inserted into the insertion chamber and a portion of the first protruding member is configured to be moved into the securing chamber.

7. A footwear system comprising:

an upper having a toe region, a heel region, and a longitudinal axis extending through the toe region and the heel region;

a heel receiving surface disposed on the upper;

a first protruding member having a first stem extending away from the heel receiving surface and a first extension extending from and end of the first stem toward the toe region;

a first heel having a first receiving portion configured to engage with the first protruding member;

a second heel having a second receiving portion configured to engage with the first protruding member;

the heel receiving surface including a tab, wherein the tab includes a wall extending from a point on the heel region furthest from the toe region and a flange extending from an end of the wall toward the toe region and wherein the wall is configured to abut a rear side of both the first heel and the second heel and wherein the flange has a width that is less than the width of the upper;

wherein the first protruding member and the tab are both substantially the same height and are both substantially aligned with the longitudinal axis of the upper;

the first heel having a first slot configured to receive the tab; and the second heel having a second slot configured to receive the tab.

8. The footwear system according to claim 7, wherein the first receiving portion includes an insertion chamber and a securing chamber.

9. The footwear system according to claim 8, wherein the insertion chamber is uncovered and the securing chamber includes a lip, wherein the insertion chamber is contiguous with the securing chamber so that the first protruding member is configured to be initially inserted into the insertion chamber and a portion of the first protruding member is configured to be moved into the securing chamber, and wherein the first extension is configured to be moved into the securing chamber and positioned underneath the lip.

10. The footwear system according to claim 7, further comprising a second protruding member having a second stem extending away from the heel receiving surface and a second extension extending from an end of the second stem toward the toe region.

11. The footwear system according to claim 10, wherein the second protruding member is substantially the same length as the first protruding member and the tab.

12. The footwear system according to claim 11, wherein the second protruding member is substantially aligned with the first protruding member and the tab.

13. The footwear system according to claim 7, wherein the first heel includes an athletic heel and the second heel includes a kitten heel.

14. A footwear system comprising:

an upper having a toe region and a heel region;

a heel receiving surface disposed on the upper;

a tab including a wall extending from an edge of the heel receiving surface in a location opposite the toe region and a flange extending from the wall toward the toe region, the flange having a width that is less than the width of the upper;

a first protruding member disposed between the toe region and the tab and having a first stem extending away from the heel receiving surface and a first extension extending from the stem toward the toe region;

wherein the first protruding member and the tab are both substantially the same height;

a group of heels configured to be removably attached to the heel receiving surface, wherein each heel includes a slot disposed on a rear side of the heel and configured to receive the flange of the tab and wherein each heel includes an insertion chamber configured to receive the first protruding member;

wherein the wall of the tab is configured to be exposed and to abut the rear side of each of the heels when each of the heels is engaged with the heel receiving surface;

a locking mechanism disposed on the heel receiving surface between the first protruding member and the toe portion;

the locking mechanism comprising a spring and a vertical surface;

wherein the spring is configured to be compressed into the upper to release the locking mechanism; and wherein the vertical surface is configured to abut a corresponding surface on a front side of each heel in the group of heels.

15. The footwear system according to claim 14, wherein one heel of the group of heels includes an athletic heel.

16. The footwear system according to claim 14, further comprising a second protruding member having a second stem extending away from the heel receiving surface and a second extension extending from the second stem toward the toe region.

17. The footwear system according to claim 16, wherein the locking mechanism, the tab, the first protruding member, and the second protruding member are substantially aligned with a longitudinal axis of the upper.

18. The footwear system according to claim 16, wherein the tab, the first protruding member, and the second protruding member are all substantially the same height.

19. The footwear system according to claim 18, wherein the wall of the tab extends along an entire rear edge of the upper.

20. The footwear system according to claim 14, wherein each of the heels and the wall of the tab have substantially the same width as the heel receiving surface.

* * * * *